United States Patent [19]

Bauer

[11] 4,272,747

[45] Jun. 9, 1981

[54] SOLENOID HOUSING

[76] Inventor: Patrick G. Bauer, 9150 E. Starring La., Eden Prairie, Minn. 55344

[21] Appl. No.: 60,481

[22] Filed: Jul. 25, 1979

[51] Int. Cl.[3] ..... H01F 7/08

[52] U.S. Cl. ..... 335/257; 335/261

[58] Field of Search ..... 335/255, 258, 260, 261, 335/278, 251, 257, 277

[56] References Cited

U.S. PATENT DOCUMENTS

| | | | |
|---|---|---|---|
| 2,407,963 | 9/1946 | Persons | 335/261 |
| 3,166,692 | 1/1965 | Forrester et al. | 335/251 |
| 3,249,823 | 5/1966 | Beardow | 335/260 X |
| 3,605,054 | 9/1971 | Conrath | 335/260 X |
| 3,626,342 | 12/1971 | Green | 335/257 |

*Primary Examiner*—George Harris

*Attorney, Agent, or Firm*—Douglas L. Carlsen; Michael E. Kiteck, Jr.

[57] ABSTRACT

In a solenoid switch, a cylindrical externally threaded housing having an integrally formed bottom wall with an axially centered aperture, a solenoid coil disposed axially within the housing with upwardly extending leads, a plunger within the coil having an actuator pin extending downwardly through the aperture, a cover of plastic material on the housing embedding a pair of connectible terminals each of which is connected to one of said leads, whereby as electrical energy is transmitted to the terminals the coil will be energized to move the plunger axially so that the pin may perform a desired work outside of the housing.

12 Claims, 5 Drawing Figures

SOLENOID HOUSING

BAKCGROUND OF THE INVENTION

Short stroke solenoids are conventionally mounted within housings adapted to fit within a frame member of the machine or apparatus on which the solenoid performs its work. The housing in many installations is threaded into the frame member and is closed at its ends with openings therein for the solenoid plunger and the electrical leads to the coil.

Present designs, while effective, lack maximum efficiency in that the housing is not adapted to hold as large a coil as desirable within a set external diameter. Also present designs are not fully self-contained in that they incorporate lead wires the loose extended ends of which must be connected to a power source.

SUMMARY OF THE INVENTION

A primary object of the present invention is to provide a compact, unitary housing for a solenoid switch which has a screw base for ready installation and which is so designed as to have an internal chamber which is receptive of a maximum sized solenoid coil relative to the housing diameter.

Another object is to provide a solenoid switch for use in operating hydraulic valves or the like wherein the solenoid is completely enclosed within a housing adapted to be threaded into the mechanism operated thereby with fixed terminals connectible to a source of electrical energy.

With these and other objects in view the invention broadly comprises a solenoid unit having a cylindrical housing with one end portion externally threaded and with said end closed by a bottom wall having a centered aperture. The opposing end of the housing is sealed by a cap of plastic material in which a pair of terminals are anchored. The housing has an interior chamber which holds the solenoid coil with leads connected to the terminals and an armature or plunger slidable within the coil which is connected to an actuator pin which extends outwardly through the aperture in the bottom to perform a work function when the coil is energized to move the armature.

DESCRIPTION OF THE PREFERRED EMBODIMENT

Figure 1:
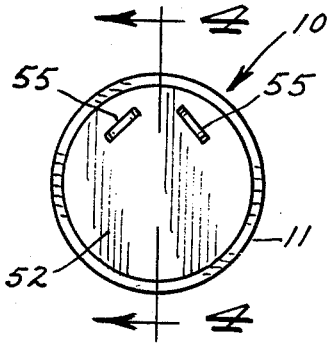
FIG. 1 is an end view of the solenoid unit.
Figure 2:
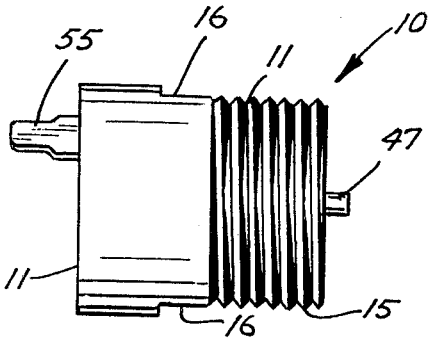
FIG. 2 is a side elevation of the unit.
Figure 3:
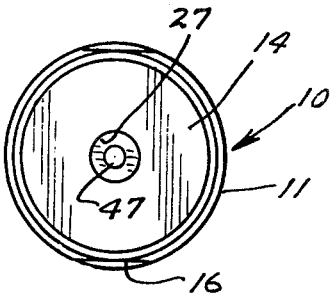
FIG. 3 is an end view of the unit from the opposite end of FIG. 1.

Referring now more particularly to the drawing, reference numerals will be used to denote like parts or structural features in the different views. The solenoid unit is denoted generally by the numeral 10 and the basic framework of the unit 10 is a solenoid housing denoted generally by numeral 11. The housing 11 has a generally cylindrical shape with an annular side. wall 12 with an end or bottom wall 14 closing one end. The end portion of side wall 12 adjacent to the wall 14, which for convenience will be referred to as the lower portion, is externally threaded as at 15 for threading the unit into a suitable female socket in the apparatus in which it is to perform its intended function. The upper portion of the housing wall 12 is somewhat enlarged from the threaded portion 15 and is provided with diametrically opposing flats 16 for suitable gripping by a wrench.

The upper end of housing 12 is open and the interior of the housing is formed with axially spaced stepped upwardly facing ledges at 18, 19 and 20. The interior wall tapers gradually inwardly from the ledge 20 to the open end of the housing as at 21.

The bottom wall 14 of the housing has an elongated boss 24 extending upwardly therefrom and disposed concentrically within wall 12. Passageway 25 in the boss 24 is axially aligned with a center aperture 26 in the bottom wall 14. Wall 14 is also provided with a recess 27 on its outer side surrounding aperture 26.

It will be noted that passageway 25 is somewhat larger in diameter than the aperture 26. A tubular bushing 29 preferably of bronze material is press fit into the passageway 25 with its center opening 30 aligned with and of substantially the same diameter as aperture 26. The housing 12 is also provided with a small longitudinally extending relief channel 31 in one side wall, the purpose of which will be subsequently explained.

The solenoid coil denoted generally at 32 is of conventional construction. It has a tubular brass sleeve 34 on which the copper coil windings 35 are wound. Leads 36 from the coil (FIG. 4) are positioned to extend upwardly through channel 31 when the coil is positioned in the housing 11. The sleeve 34 is of such a diameter as to have a close sliding fit around the boss 24.

The plunger or armature of the solenoid is denoted generally at 40 and includes a head 41 and a pin 47. The head 41 is formed of low carbon steel and has a cylindrical body portion 44 adapted for an axial sliding fit within the sleeve 34 and with an enlarged disk shaped cap 45 at its outer or upper end. Body portion 44 has an internally threaded axial bore 46. An elongated guide or actuator pin 47 has one end portion 48 threaded into the bore 46 with the remainder of the pin projecting outwardly through the bushing 29 and aperture 26. A stop flange 49 on the pin 47 limits inward screw threading of the pin into body 44.

A split ring flat metal washer 50 is positioned to lie against the ledge 18 and fit snugly within the interior wall of the housing.

In assembling the solenoid unit the coil 32 is first placed in the housing 11 in the position shown with the sleeve 34 encircling boss 24 and with the coil leads extending outwardly through channel 31. An epoxy material (not shown) may then be poured around the coil to hold it in place. Washer 50 is then inserted into position against the ledge 18. Plunger 40 is inserted with the body portion 44 disposed within sleeve 34 and pin 47 projecting outwardly or downwardly through bushing 29 and aperture 26. In this condition body 44 engages the end of boss 24 leaving disk 45 spaced slightly from the washer 50.

Figure 4:
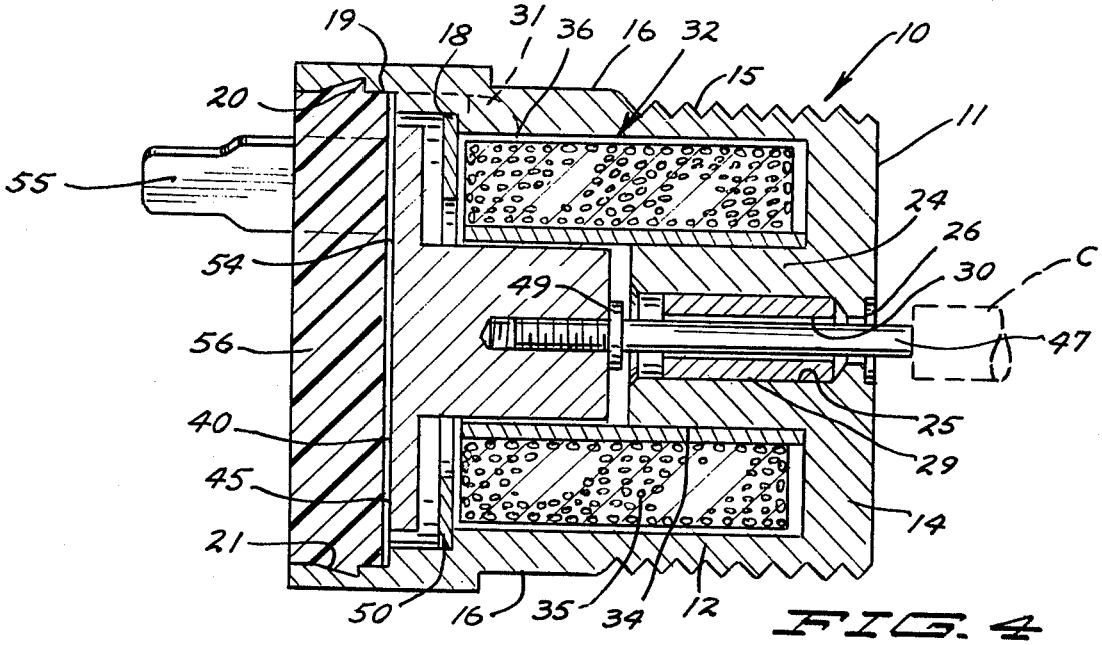
FIG. 4 is a diametrical cross section through the unit taken on line 4—4 of FIG. 1 with the solenoid in deenergized condition.
Figure 5:
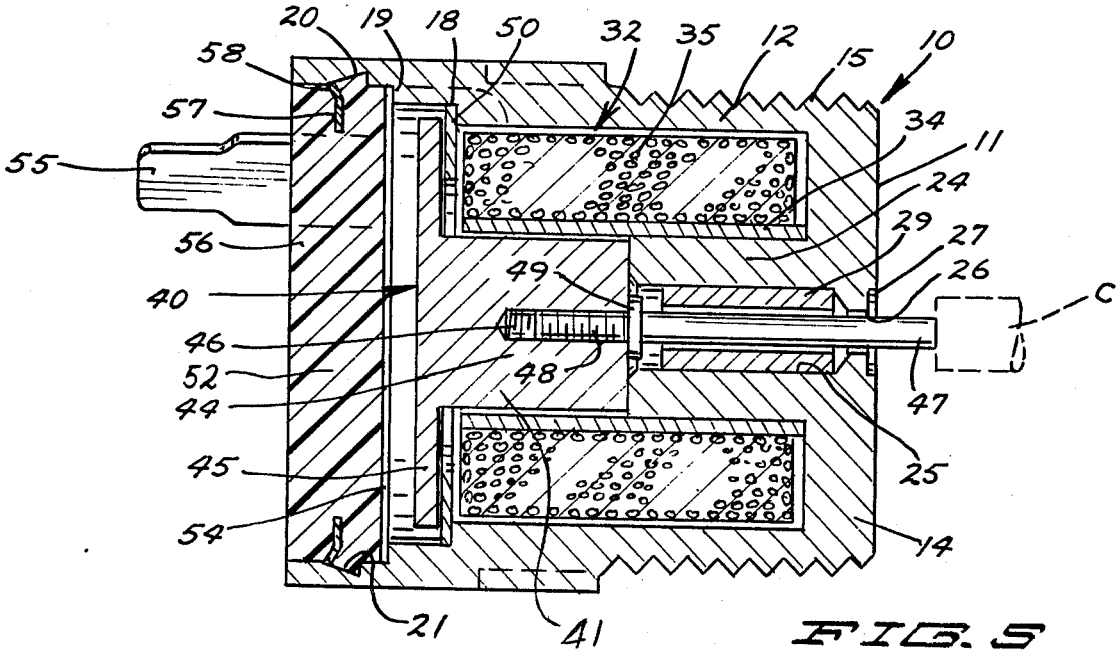
FIG. 5 is identical to FIG. 4 but the solenoid energized and the armature in operative position.

A retention cap 52 is provided on the housing 11 to close the upper open end thereof, or the end shown a the left in FIGS. 4 and 5. This cap includes a disk 54 of phenolic material which rests upon the ledge 19. This leaves a substantial space between the disk 54 and disk 45 when the body 44 of the plunger is at rest against the end of boss 24 as shown in FIG. 5. The leads 36 from the coil 35 extend around or through the disk 54 and are connected to plug in terminals 55 which are preferably anchored to disk 54 in the desired spaced and relative positions as best shown in FIG. 1.

The retention cap 52 is then completed by pouring a layer 56 of plastic epoxy material over the disk 54. This material completely seals the open end of the housing 11 and flows into the peripheral recess formed by the ledge 20 and tapered wall 21 to provide a lock between the cap 52 and housing 11 when the epoxy hardens.

In an alternative construction, shown in FIG. 5, a retention washer 57 having an angular flange 58 for engagement against wall 21 is embedded in the layer 56. Washer 57 further reinforces the cap 52 against outward displacement from the housing 11. As another alternative a split snap ring may be used to engage in the groove formed by the surfaces 20 and 21.

When the epoxy layer 56 has hardened the upper end of the housing 11 is sealed and terminals 55 will be anchored in fixed position ready for insertion into a compatible electric outlet.

When the solenoid unit 10 is installed for operation, the pin 47 will be engaged endwise against an exterior component C which is yieldably biased, as by spring or hydraulic pressure, toward the unit 10. When component C is moved away from unit 10 it will initiate a desired sequence of events within the machine in which the solenoid is installed. Energization of the solenoid coil through the connection of terminals 55 with a source of electric power will move armature 40 outwardly or downwardly to the position shown in FIG. 5 to perform its operative function on component C.

However, when the coil 35 is deenergized the retractive pressure on component C will force the armature inwardly so that disk 44 hits sharply against disk 54 as shown in FIG. 4. The return force or backlash tends to force the cap 52 out of the housing. However, the interlock at 20, 21 resists such removal. Where the washer 57 is used (FIG. 5) the resistance becomes even greater and more positive.

The invention accordingly provides a compact unitary solenoid housing which permits a maximum coil size within given diametrical and axial dimensions for maximum force in the solenoid switch. Additionally the housing has a unitary construction eliminating the necessity of external wires and minimizes heat problems within the solenoid unit. The housing cap is so designed and installed as to minimize the chances of displacement thereof as a result of backlash forces imposed upon the solenoid.

Having now therefore fully illustrated and described my invention, what I claim to be new and desire to protect by United States Letters Patent is:

1. In a solenoid, (a) a housing having an externally threaded cylindrical side wall and a bottom wall integrally formed therewith, (b) the bottom wall having an axially centered aperture, (c) an energizable electric coil disposed within the housing and having upwardly extending leads, (d) an armature comprising a head and actuator pin, the head of which further comprises a cylindrical body portion and an enlarged disc-shaped cap, in the coil movable by energization thereof and having the actuator pin extending through said aperture, (e) a dielectric cap on the housing having electric terminals mounted thereon, and (f) said leads connected to said terminals.

2. The subject matter of claim 1 wherein said cap is formed of an epoxy material.

3. The subject matter of claim 1 wherein said housing side wall is provided with diametrically opposing external flat surface portions for wrench engagement.

4. The subject matter of claim 1 wherein said cap is spaced slightly above the armature to limit upward movement of the armature when the coil is deenergized.

5. The subject matter of claim 1 wherein said housing is provided with an internal upwardly facing annular shoulder just above the coil, a washer supported on the shoulder, and said armature extending through the washer and having an enlarged head portion.

6. In a solenoid switch, (a) a cylindrical metallic housing having an externally threaded annular wall with one end closed by a bottom wall having a central aperture therein and the other end open leaving a chamber within the housing, (b) a cap of dielectric material closing the open end of the housing, (c) said cap having electric terminals embedded therein, (d) an electric solenoid having a coil and armature disposed within the chamber with electric leads from the coil connected to said terminals, (e) said armature including a head and actuator pin, the head of which further includes a cylindrical body portion and an enlarged disc-shaped cap, (f) said armature including an actuator pin projecting outwardly through and beyond the bottom wall aperture for operative engagement with an operable element, and (g) annular retention means embedded in the cap and engageable with the housing to resist outward removal of the cap from the housing.

7. The subject matter of claim 6 wherein said retention means is a flat washer with a peripheral angular flange engaging against the interior surface of the housing annular wall.

8. The subject matter of claim 5 wherein said washer is made of metal.

9. The subject matter of claim 8 wherein the enlarged head portion of the armature is slightly above the washer.

10. The subject matter of claim 6 wherein said housing is provided with an internal upwardly facing annular shoulder just above the coil, a metal washer supported on the shoulder.

11. The subject matter of claim 10 wherein the coil of the solenoid has a brass sleeve on which the coil windings are wound.

12. The subject matter of claim 11 wherein the coil is embedded in epoxy.

* * * * *